United States Patent [19]

Brooker et al.

[11] 4,437,831

[45] Mar. 20, 1984

[54] BURNER HEAD

[75] Inventors: Michael F. C. Brooker; Steven J. McKerihen, both of Toronto; Hashmukrai D. Attwala, Scarborough; Antonio L. Cautillo, Toronto, all of Canada

[73] Assignee: Aero Environmental Limited, Toronto, Canada

[21] Appl. No.: 201,346

[22] Filed: Oct. 27, 1980

[51] Int. Cl.[3] ..... F23C 5/08; B05B 3/00

[52] U.S. Cl. ..... 431/177; 431/351; 239/225

[58] Field of Search ..... 431/183, 265, 177, 350, 431/351, 353, 354; 239/405, 406, 224.5, 225

[56] References Cited

U.S. PATENT DOCUMENTS

| | | | |
|---|---|---|---|
| 2,738,837 | 3/1956 | McGillis | 431/177 |
| 3,820,943 | 6/1974 | DeLancey | 431/265 |
| 4,077,761 | 3/1978 | Dollinger | 431/353 |

FOREIGN PATENT DOCUMENTS

| | | | |
|---|---|---|---|
| 54-113536 | 9/1979 | Japan | 431/350 |

*Primary Examiner*—Samuel Scott
*Assistant Examiner*—G. Anderson
*Attorney, Agent, or Firm*—K. Maxwell Hill

[57] ABSTRACT

A gas burner head for bushing out or spreading a gas flame adapted for use in an oil burning firebox which comprises in combination with a gas delivery tube and an air power, forced air, surrounding, air delivery duct, a pair of closely adjacent plates spaced at right angles to the cylinder-axis of the nozzle of the gas delivery tube. The nozzle abutts the outer or spreading one of the plates and is circumferentially perforate on its upper sides in the space between the plates to deliver gas therebetween. The air delivery duct has an air discharge opening surrounding the outer edges of the plates which is of an area greater than that of said nozzle and spreading plate but providing relatively narrow circumscribing air passage therebetween. The areas of said plates are predominately circular with the outer spreading plate of smaller diameter than the inner nozzle plate. The plates are provided with a plurality of substantially concentric rings of spaced apertures for directing gas and air and gas-air mixtures to the front of the burner head.

2 Claims, 3 Drawing Figures

BURNER HEAD

FIELD OF INVENTION

The present invention relates to a novel burner head for use with apparatus employed in the conversion of oil fired heating furnaces to natural gas or propane fired furnaces where the oil burner head is replaced by a burner head assembly adapted to burn natural gas. In particular the invention herein disclosed provides a burner head assembly for use in domestic gas power burners which develops a short self contained flame and which incorporates the standard oil burner housing to carry a volume of high velocity air to become the combustion air stream necessary to allow a gas burner to maintain a stable flame while discharging combustion by-products at adequate rates.

BACKGROUND OF THE INVENTION

There is a present demand for devices and means for converting furnaces using oil for combustion heat to ones capable of using gas. It is common in the domestic marketplace to replace a whole furnace when it is desired to convert to gas from oil as the source of fuel. There is a need for a gas burner that can be used in the combustion chamber of an oil furnace. Such a burner must be capable of creating a self controlled flame and must have fan and motor means of sufficient capacitor to create a velocity of air to maintain a stable flame.

The oil to gas conversion burners now known are fan assisted type burners. Fan assisted burners have combustion air supplied by a fan or blower of sufficient force pressure to overcome the burner resistance only and the flame produced at the burner head is of a long laminar shape. A long laminar flame cannot be properly contained in the combustion chambers of the commonly used domestic oil fired furnaces. The long flames created by the commonly used gas burners causes the heat exchangers to readily burn out in oil furnaces since they have been designed to contain the bushy flames common to oil burners.

Gas burner manufacturers have made various types of flame spreader devices for attachment to gas burner heads to maintain the gas flame within the oil furnace combustion chamber and thereby to protect the furnace heat exchangers, but it is known that the devices developed to date fail from thermal fatigue after short usage and are not therefore, acceptable in the domestic burner market.

Another disadvatage of fan assisted burners is that they will not function in an appliance that has restrictions such as baffles or revertable flues. Known burners cannot achieve the pressure required to move the combustion by-products through the appliance and at the same time maintain acceptable by-product levels. Attempts at increasing the fan capacity to meet the required pressure levels have merely resulted in creating an unstable flame.

OBJECT OF THE INVENTION

It is the principal object of the invention to provide an oil furnace combustion chamber with a burner head capable of burning natural gas or propane gas with a short bushy flame while maintaining a high velocity stream of exit combustion by-products.

SUMMARY OF THE INVENTION

It is known that gaseous infusion flames are not commonly used in furnaces for heating whereas pre-mixed air and fuel are common. Gaseous infusion burning methods are known to create flame instability and give unacceptable levels of carbon monoxide. The applicants herein have found that stabilization of the flame can be achieved by creating areas of low air and gas velocities at the point in the combustion head where the fuel and the oxidizer are brought together and maintained in the proper proportion for the reaction of combustion. The following described structure has achieved the desired result.

The flame retention head for a gas burner herein, consists of a turbostatic means set in the air passageway of the burner and spaced across the path of travel of the flow of air driven into the air passageway. The turbostatic means is close to the end of the gas duct which leads axially through the passageway for the air and terminates with the passageway within the combustion chamber of the furnace. The burner head comprises a pair of flame stabilizer discs fixed across and to the end of the gas conduit. The outer facing disc blocks the end of the gas conduit and is of smaller diameter than the inner disc. The discs are spaced apart sufficiently close only to accomadate a portion of the end of the gas conduit having a plurality of upwardly facing ports enclosed therebetween.

Co-axial apertures are bored through each disc in concentric array with the gas conduit ports centred about the rows of apertures thus formed. The natural gas fuel is introduced to the head from the ports between the discs of the head and enters the head radially of the discs. High velocity oxidation material such as air is introduced to the head from the air passageway which terminates behind the inner disc. There is a space between the end of the outer wall of the passage for the air and the edges of the discs thereby allowing air to flow past and around the head. Some of the air passes through the apertures in the inner disc and mixes there with the gas emerging from the conduit ports and then pass through the apertures in the outer disc mixed together and with low turbulent velocities where it is readily ignited. The partial pre-mixing of the air and gas at the central front region of the head ensures the existence of a stoichiometric mixture there during operation of the burner and the low velocity of the mixture in the front of the head ensures a continuous flame stability for the device.

Only a fraction of the gas is pre-mixed and carried through the apertures in the front disc. Most of the gas reaches the periphery of the front disc by the apertures in an unmixed state and is there mixed with the air coming through the outer row of apertures in the inner disc which open directly into the space forward of the head. The larger inner disc also serves as a bluff obstacle preventing blowoff and also serves to create an inner reverse flow in the region directly in front of the burner. The gas-air mixture made at the front of the head by the flow of air from the peripheral sides of the burner and discs is readily ignited by the constantly stabilized portion of the mixture forming in the centre region of the outer disc.

The high velocity of the air emerging from between the rear disc and the wall of the air passageway, which has been turbulated by the turbo-static disc, shapes and constrains the flame. In addition the air leaving the space between the discs and the air passage becomes a source of secondary air for serving to be carried by the combustion reaction into and toward the combustion zone constantly stabilized in the centre region of the outer disc.

IN THE DRAWINGS

With the foregoing object in view and such other objects that become apparent from consideration of this disclosure, the present invention consists of the inventive concept which is comprised, embodied and included in the construction, method and combination of parts herein exemplified reference being had to the accompanying drawings in which like reference numerals refer to like parts.

THE PREFERRED EMBODIMENT OF THE INVENTION

Figure 2:
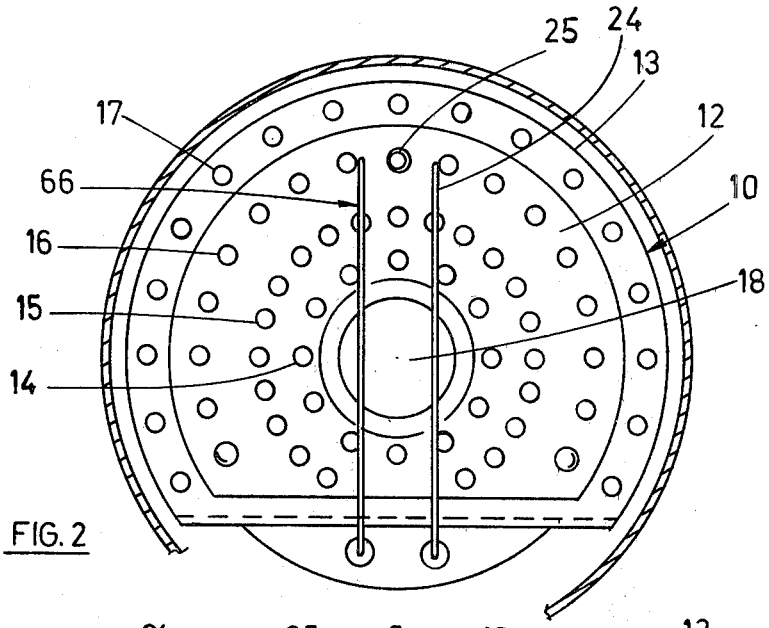
FIG. 2 is a front view of the burner head of the invention showing the relative sizes of the apertures in the discs.

The burner head of the invention is shown in FIG. 2 and is enumerated 10. It comprise a pair of discs 12,13 spaced apart from one another by spacers 21,22 which create the space or gap 20 between the discs 12,13. Three rows of concentric holes or apertures, 14,15,16 are bored into each disc and a fourth row 17 is bored into the peripheral edge of inner nozzle disc 13 to open into the region in front of the burner head 10 uncovered by spreading disc 12 as indicated by the FIG. 2. A spark igniting means 24 is shown in front of head 10, with the actual spark being created from contact 24 to ground screw 25 on a signal from heat sensor 66.

In FIG. 2 a gas conduit pipe 18 is shown with the head assembly 10, consisting of the pair of spaced apart discs 12,13, fixed to the conduit pipe 18 by a collar flange 30 mounted to the disc 13. The outer end 31 of conduit 18 abutts the inner side of spreading disc 12 in sealed shut mode. The gas is discharged from the conduit 18, only by a series of equal diameter ports 25 spaced equidistant apart around the upper part and sides of the circumference of the conduit pipe 18 extending into and between the disc space 20 as shown in FIG. 2. No ports issue along the bottom side of the portion of the pipe 18 extending into space 20.

Figure 1:
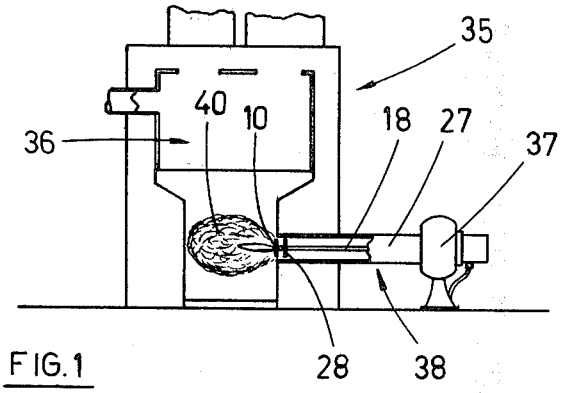
FIG. 1 shows a gas burner, partly in section, mounted for use in the combustion chamber of an oil furnace, shown partly in section.

In FIG. 1 a typical oil furnace 35 is shown with the conversion burner of the present invention, 38, installed with the burner head 10, set into the combustion chamber 36. The burner is shown partly in section to indicate the location of the gas delivery conduit 18 directed toward the head and axially mounted within the burner casing 27 which has been converted to be the forced air passageway from the fan and motor means 37 of the burner to the head 10.

Figure 3:
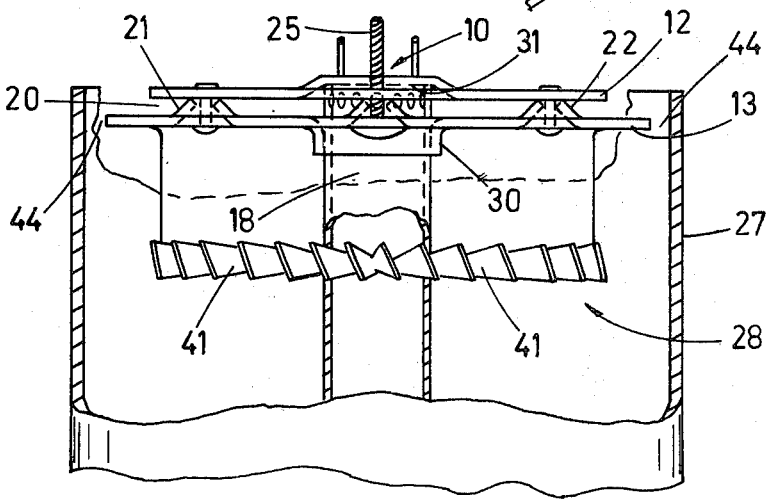
FIG. 3 is a view of the burner head from above with the air passageway partly cut away and the gas conduit cut partly away to show the dimensions of both relative to the discs.

A vane type air tubulator 28 is attached near the head of the burner to provide turbulence to the air being driven outwardly toward the head 10 by the fan and motor means 37 of the burner 38. The vanes 41 are shown in FIG. 3 and are spaced around the central axis of the conduit pipe 18.

The end of the air passageway enclosure wall 27 has its termination adjacent the plane of the outer disc 13 but is not attached to the head, as they remain spaced apart by an opening gap 44.

Numeral 40 indicates the bushy shaped flame created by the device.

What I claim is:

1. A flame spreading gas burner comprising in combination; a gas delivery tube, a gas delivering nozzle adjacent the end of said tube, an air passing inner nozzle plate, an air passing outer flame spreading plate, a turbulator, and an air delivery duct surrounding the foregoing parts, said nozzle plate surrounding said tube adjacent to and upstream of said nozzle, said flame spreading plate closing the end of said tube, said nozzle plate and said flame spreading plate being spaced and at right angles to the cylinder-axis of said tube, said nozzle being that part of the tube between the plates is circumferentially perforate between said nozzle plate and said flame spreading plate, said air delivery duct having an air discharge opening circumference greater than that of said nozzle plate and said spreading plate to provide relatively narrow circumscribing air passage therebetween; said turbulator being in the form of a set of radially disposed and uniformly skewed vanes surrounding said gas delivery tube spaced upstream from said nozzle plate and said spreading plate; the end of said gas delivery tube lying approximately in the centre of said nozzle plate and said spreading plate, said plates being closely adjacent; the area of said air discharge opening and the area of said nozzle plate and of said spreading plate are each at least predominately circular, said spreading plate being of a greater diameter than said nozzle plate, said greater diameter being occupied by a ring of air apertures, said nozzle and spreading plates being spaced apart a distance only approximately equal to that of the perforations in said tube.

2. The invention as in claim 1 in which said nozzle plate and said spreading plate are each provided with a plurality of substantially concentric rings of spaced apertures wherein at least each of the apertures of the first and inermost rings are closer to each other than the apertures of the next larger ring.

* * * * *